United States Patent [19]

Mayton et al.

[11] Patent Number: 5,000,761

[45] Date of Patent: Mar. 19, 1991

[54] GEL PRODUCING PAD AND IMPROVED METHOD FOR SURFACING AND POLISHING LENSES

[75] Inventors: Mark M. Mayton, Stanley; Alan J. LoPresti, Geneva, both of N.Y.

[73] Assignee: Ferro Corporation, Cleveland, Ohio

[21] Appl. No.: 484,449

[22] Filed: Feb. 20, 1990

Related U.S. Application Data

[63] Continuation-in-part of Ser. No. 262,838, Oct. 20, 1988, abandoned.

[51] Int. Cl.[5] ..... B24B 1/00

[52] U.S. Cl. ..... 51/295; 51/293; 51/303; 51/307; 51/308; 106/3

[58] Field of Search ..... 51/293, 295, 303, 307, 51/308; 106/3

[56] References Cited

U.S. PATENT DOCUMENTS

| | | | |
|---|---|---|---|
| 2,280,852 | 4/1942 | Robie | 51/303 |
| 2,865,725 | 12/1958 | Schroeder et al. | 51/303 |
| 2,886,923 | 5/1959 | France | 51/309 |
| 3,042,509 | 7/1962 | Soderberg | 51/293 |
| 3,921,344 | 11/1975 | Goodwin | 51/298 |
| 4,138,228 | 2/1979 | Hartfelt et al. | 51/295 |
| 4,222,747 | 9/1980 | Dauguet et al. | 51/303 |
| 4,255,164 | 3/1981 | Butzke et al. | 51/295 |
| 4,576,612 | 3/1986 | Shukla et al. | 51/295 |
| 4,733,502 | 3/1988 | Braun | 51/284 R |
| 4,788,798 | 12/1988 | DeFranco et al. | 51/406 |

*Primary Examiner*—William R. Dixon, Jr.
*Assistant Examiner*—Willie J. Thompson
*Attorney, Agent, or Firm*—Shlesinger, Fitzsimmons & Shlesinger

[57] ABSTRACT

A surfacing pad is produced by dispersing abrasive particles in a flexible, water absorbent matrix that is secured on a flexible, fabric substrate, which functions as a reservoir for a liquid. By applying to the pad a small quantity of liquid sufficient to wet the matrix and to saturate the substrate, it is possible by rubbing the surfaces of a workpiece and the wetted matrix to create an abrasive surfacing gel between the workpiece and the pad substrate, thus eliminating the need for directing a slurry or other liquid onto the workpiece during a surfacing operation.

11 Claims, 1 Drawing Sheet

GEL PRODUCING PAD AND IMPROVED METHOD FOR SURFACING AND POLISHING LENSES

RELATED APPLICATION

This application is a continuation-in-part of our copending U.S. application Ser. No. 262,838, filed Oct. 26, 1988 for Novel Gel Producing Pad and Improved Method For Surfacing And Polishing Lenses.

BACKGROUND OF THE INVENTION:

This invention relates to an improved method and product for surfacing and/or polishing lenses and the like. More particularly, this invention relates to a novel gel producing fining or polishing pad which considerably simplifies the process of fining and/or polishing lenses.

In general, the process for producing fine ground or polished surfaces on optical materials, such as for example on optical lenses, is much the same regardless of the type of fining or polishing medium employed, or the type of material being processed. In typical such operations, a fining or polishing pad is moved across the surface of the material to be processed, while either a slurry containing abrasive particles, or plain water, is directed in a stream between the pad and the surface to be processed.

One such prior art process is disclosed in U.S. Pat. No. 4,138,228, which teaches the use of a polishing pad having a water soluble, hydrophilic matrix containing unencapsulated abrasive particles that are rather weakly bonded to the matrix. This pad is used in conjunction with a constant stream of water, which assists in the release of polishing particles which are leached or torn from the pad matrix as the latter breaks down during use. In practice this pad has been found to be unsatisfactory because of the lack of contact between the released abrasive particles and the work.

U.S. Pat. No. 4,255,164 discloses a glass fining pad or sheet having a water insoluble, microcellular matrix containing abrasive fining particles. When the pad is used with an aqueous flow or stream its matrix breaks down and allegedly releases the fining particles at a controlled rate. While being effective for the grinding or fining stages of surfacing, this type of pad is not effective for polishing, even when using a polishing grade abrasive.

U.S. Pat. No. 4,576,612 discloses a polishing pad having a water soluble matrix containing polishing particles. A stream of water which is directed onto the interface between the pad and the work causes the exposed surface of the matrix slowly to dissolve thus slowly releasing polishing particles.

U.S. Pat. No. 3,042,509 also discloses a wax-like, polyethylene based polishing compound containing polishing particles, and adapted to be rubbed onto the surface of a buffing wheel or lap to provide both lubricating and polishing properties for the wheel or lap surface. The compound is water-soluble so that it can be washed off of the wheel after the buffing operation.

Still other such prior art processes showing desirability of directing a slurry or other liquid in a stream to the interface between the work and a grinding or polishing pad are disclosed in U.S. Pat. Nos. 3,921,344; 3,959,935; 3,522,680; 3,225,497; 3,128,580 and 2,886,923.

None of the above-noted patents, however, discloses a pad designed to produce an abrasive gel upon being wetted. Moreover these prior art processes involve several problems, including the following:

A. It is difficult to keep the abrasive particles suspended in the liquid slurry or stream; or in other words, to prevent the settling out of the particles.

B. Large amounts of abrasive particles tend to stick to and to dry upon the processing equipment.

C. Frequent repair and replacement of pumps, which are used to circulate the abrasive slurry, are necessary.

D. It is extremely difficult to mix and control the concentration of the abrasive slurry.

One object of this invention, therefore, is to provide an improved fining or polishing process which eliminates the need for directing a stream of water or liquid slurry onto the work, thereby circumventing many of the problems associated with the previously mentioned processes.

To this end it is an object also to provide a novel fining or polishing pad which in the presence of a small amount of water forms a very viscous gel, which adheres both to the object being polished and to the pad substrate.

Still another object is to provide a novel water absorbent or adsorbent pad which, when wetted, makes all of its abrasive material instantly available for fining or polishing.

A further object of this invention is to provide a novel pad of the type described having an abrasive-containing matrix made from a polymer which can absorb and retain large amounts of water to enable formation of a long lasting gel.

Still another other objects of the invention will be apparent hereinafter from the specification and from the recital of the appended claims, particularly when read in conjunction with the accompanying drawing.

SUMMARY OF THE INVENTION

The hereinafter described pad provides a disposable, self-contained article for fining or polishing the surfaces of various materials (plastics, metals, glass, ceramics, etc.) using only a small amount of a liquid agent to produce between the pad and the work a gel which contains abrasive particles (fining or polishing). The abrasive particles (aluminum oxide, cerium oxide, etc.) are dispersed in a water absorbent or adsorbent, gel-producing carrier or matrix, which is coated uniformly onto a flexible reinforcing substrate, such as for example a fabric of the type used for conventional polishing or finishing pads. An adhesive is applied to the back of the substrate, and the entire structure is cut to form a conventionally shaped, multi-petal pad. The pad is attached to surfacing lap and its matrix and substrate are wetted with a small amount of liquid. The motion of the lap forms on the pad a gel, which acts like a viscous slurry to surface the associated workpiece.

The optimum abrasive carrier or matrix provides rapid gelation, uniform dispersion of surfacing agent, lubrication between the lap or other surfacing substrate and the object being fined or polished, and produces a viscous matrix which retains or prevents loss of the abrasive The preferred, matrix-supporting substrate is a fabric capable of absorbing water to function as a reservoir for the gel produced during use. The replacement of a slurry with a gel producing matrix eliminates the need for preparing, storing, and disposing of liquid slurries. It also reduces machine maintenance and clean-up-time.

It has been found also that the above-noted pad is even more effective if its substrate is provided with a series of recesses or holes which function to store a greater amount of the matrix. Moreover, instead of coating the gel-producing carrier or matrix onto a flexible reinforcing substrate, such as a polishing or finishing pad, it has been found that the mixture of the abrasive particles and the carrier or matrix can be applied in the form of a paste, or the like, directly to the surface that is to be fined or polished.

THE DRAWING

In the drawing:

FIG. 4 is a plan view of a gel producing fining or polishing pad made according to a second embodiment of this invention; and FIG. 5 is an enlarged, fragmentary cross sectional view taken generally along the line 5—5 in FIG. 4 looking in the direction of the arrows

DETAILED DESCRIPTION OF THE PREFERRED EMBODIMENTS

Figure 1:
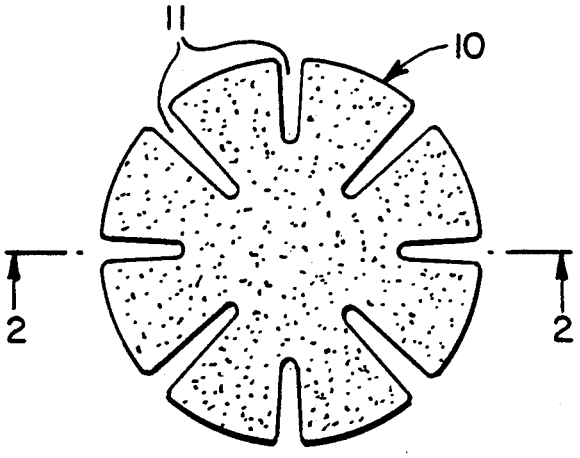
FIG. 1 is a plan view of a gel producing fining or polishing pad made according to one embodiment of this invention.
Figure 2:
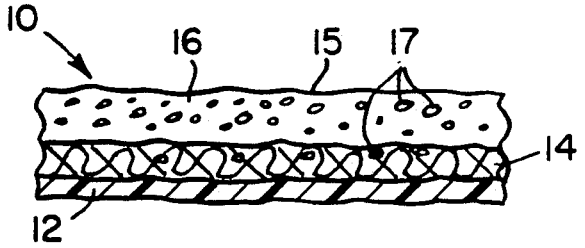
FIG. 2 is an enlarged, fragmentary cross sectional view taken generally along line 2—2 in FIG. 1 looking in the direction of the arrows.
Figure 3:
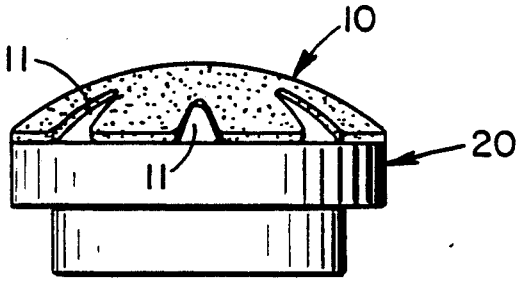
FIG. 3 is a side elevational view of a conventional fining or polishing lap as it appears with the pad of FIG. 1 secured thereon.

Referring now to the drawing by numerals of reference, and first in the embodiment and first in the embodiment illustrated in FIGS. 1 to 3, 10 denotes generally a gel producing surfacing pad having therein the usual radial slots 11, which lend to the pad the conventional appearance of a petal-shaped pad. Pad 10 comprises several parts, each of which is responsible for a distinct function. For example, 12 denotes the attachment layer—which, as noted hereinafter is used to attach the pad 10 to a lap or the like.. This layer 12 may be any adhesive well known to the industry, such as for example a PSA adhesive.

Numeral 14 denotes the substrate layer. This layer has several functions. It provides an intermediate supporting layer between the attachment layer 12 and the hereinafter described surfacing layer; it provides a pliable surface which keeps the hereinafter described abrasive particles in contact with the surface which is being polished or fined; it retains a small amount of abrasive particles in its structure; and in use it acts as a reservoir for the wetting liquid. Any number of synthetic or natural pliable sheet materials can be used for the substrate layer 14, including but not limited to cotton, felt, paper, and woven or non-woven synthetics. These materials can be in flocked form, or may be altered in other ways (perforated, embossed, etc.) to help them retain abrasive particles and the surfacing layer or particle carrier layer.

The surfacing or particle carrier layer is denoted at 15, and comprises, preferably, a water absorbent or adsorbent matrix 16 containing abrasive particles 17. Layer 15 is the key component of the gel producing abrasive pad, and as noted hereinafter usually is coated as a paste onto substrate 14 in the range of approximately 10 milligrams to more than 250 milligrams of paste per square centimeter of the substrate surface. When applied in this manner, part of the matrix 16 and its particles 17 penetrate to a certain extent into the fabric substrate (FIG. 2), particularly in those cases where layer 14 is flocked or felted. Layer 15 has multiple functions which should be balanced to produce a good quality surface in the shortest amount of time. For example, the abrasive particles 17 preferably have a Knoop hardness of greater than 1000, and are of a particle size distribution which allows for rapid stock removal with the least amount of scratches left on the surface. For use as a polishing pad the particles 17 preferably should have an average particle size of 0.1 to 10.0 micrometers or microns, and for fining pads a range of from 10.0 to 50.0 micrometers is recommended. Abrasives that can be used include, but are not limited to, cerium oxide, aluminum oxide, silica, etc.

The gelling agent or matrix 16, which forms a gel on contact with a liquid, provides a medium which holds the abrasive particles 17 in the presence of a liquid between the substrate 14 and the material being surfaced (not illustrated). The matrix 16 is capable of holding relatively large amounts of liquid, which takes on swarf from the abraded surface, provides lubrication between the pad and the object being surfaced, and can provide cooling to materials which are heat sensitive. Materials suitable for creating matrix 16 include cellulose based materials, clays, alumina-silicates, polymer silicas, and similar materials. Other additives can be used in conjunction with the gelling agent or matrix 16, such as chemical polishing accelerators, coolants, oxidation inhibitors, etc.

Some typical examples of the invention are as follows:

EXAMPLE NO. 1

Polishing Pad

Preparation of gel/abrasive matrix:

Part (A) 20 grams of propylene glycol and 10 grams of a sodium carboxymethylcellulose carrier, such as for example the type known as CMC 7L and sold by Aqualon of Wilmington, Del., were mixed until well dispersed.

Part (B) 160 gr. of water, plus 5 gr. of a dispersant known as Darvan 7, which is sold by Vanderbuilt Co. of Norwalk Conn., and 150 gr. of aluminum oxide, having an average particle size of approximately 2.5 microns were mixed until well dispersed.

Part B was then mixed into Part A until the mixture was a smooth paste. Ratio of abrasive (150 gr.) to dry carrier (10 gr.) was 15:1.

The mixture of parts A and B was then coated as a layer 15 onto a pad substrate 14 which comprised of a commercially available flocked polyester fabric such as 0.020 inch rayon flock sold by Tempo/Shane of Peabody Mass.

The layer 15 of paste was coated on substrate 14 to a thickness of approximately 0.005–0.008 inches. The fabric 25 substrate 14 was then placed in an oven at 300° F. for five minutes so that the matrix 16 becomes dry or dehydrated. After cooling the fabric, a pressure sensitive adhesive layer 12 was attached to the back of layer 14, and pad 10 was cut to its desired shape using a steel rule die.

Testing

Each of a first set of polishing pads made according to Example No. 1 was mounted on a lap 20 and saturated with about 20 ml. of water, enough to wet the matrix 16 and to saturate the reservoir layer or substrate 14. The lap was put on a Coburn 505 polishing machine set on low speed and at a pressure of at 20 psi. A fined plastic lens (Supremacy 65 from Coburn Optical Industries, Muskoge, Okla.) was mounted and (polished) run for three minutes for each pad.

A second set of pads was prepared and run using the same procedure, except that in preparing part A of Example No. 1, the amount of propylene glycol was increased to 40 grams, and each pad was not saturated with water.

A third set of pads was prepared and run using the same gel/abrasive matrix and polyester fabric as in the first set, but the uncoated pad fabric was first attached to the lap, after which 4 grams of paste was smeared onto each pad.

| RESULTS | |
|---|---|
| First Set of Pads | |
| Number of tests | 10 |
| Range of removal | 15 mg. to 31 mg. |
| Average removal | 25 mg. |
| Surface quality | Equal to current industry standards |
| Optical quality | Very Good |
| Second Set of Pads | |
| Number of tests | 3 |
| Range of removal | 10–21 mg. |
| Average removal | 14.3 |
| Surface quality | Equal to low quality commercial lens. |
| Optical quality | Passable |

| | |
|---|---|
| Third Set of Pads | |
| Number of tests | 1 |
| Removal | 23 mg. |
| Surface quality | Equal to industry standard |
| Optical quality | Very good |

EXAMPLE NO. 2

Fining

Preparation of gel/abrasive matrix:

Part (A) 150 grams of Fine-Rite 0.025 Alumina, produced by Ferro Corp., Penn Yan, N.Y. plus 100 grams of deionized water, and 5 grams of Darvan 7, all of which were mixed until well dispersed.

Part (B) 15 grams of carboxymethylcellulose (CMC 7L) plus 23 grams of propylene glycol were mixed until well dispersed. Part B was then mixed into Part A under agitation. Ratio of abrasive (150 gr.) to dry carrier (15 gr.) was 10:1.

This mixture was coated as a layer 15 onto a 0.005 inch glass-polishing fabric substrate, which was the type sold by Pellon of Chelmsford, Mass. at a thickness of 0.005 inches, and placed in a 300° F. oven until dry. The cooled material was laminated to a pressure sensitive adhesive layer 17 and a multi-petal pad was die-cut from this material.

Testing

The fining pad of Example No. 2 was mounted on a lap 20 and saturated with about 20 milliliters of water. The lap was put on a Coburn 505 polishing machine set on low speed at a pressure of 20 psi. A plastic lens was mounted and run (fined) for two minutes by the pad of Example No. 2.

Results: Finishing Pad (A)
Number of tests: 1
Removal: 44 mg.
Surface quality: Very good.

EXAMPLE NO. 3

Polishing

20 grams o: alumina having an average particle size of approximately 2.5 microns was mixed with 8 grams of Clay Bentone SD-1 (NL Chemicals) and 25 grams of deionized water until well dispersed. Ratio of abrasive (20 gr.) to dry carrier (8 gr.) was 2.5:1.

Testing

The paste was coated on a flocked polyester pad or substrate 14, which was then attached to a polishing lap. The lap was attached to a Coburn 505 polishing machine and run for three minutes on low speed at a pressure of 20 psi. A plastic lens was used.

Results: Polishing Pad (A)
Number of tests: 1
Removal: 21 milligrams
Surface quality: Equal to current industry standards
Optical quality: Very good As used herein, the term gel is intended to have its common meaning, such as for example a substance which is a colloid in which the dispersed phase has combined with the continuous phase to produce semi-solid material, such as a jelly. (See the American Heritage Dictionary of the English Language, published by American Heritage Publishing Co., Inc. of New York, N.Y., copyrighted 1969, 1970, fourth printing.) Likewise, the term wetted as used herein is intended to have its conventional meaning, such as defined i the above-noted dictionary as meaning to make wet; moisten or dampen: such as wetting a sponge.

From the foregoing, it will be apparent that the present invention considerably simplifies the process and apparatus heretofore required to fine grind and/or to polish rigid surfaces, such as for example the surfaces of optical lenses By using a special gel-producing pad, it is possible to eliminate the need for directing a stream of liquid slurry or water onto the interface between a pad and lens, for example, thus eliminating also the need for using recirculating pumps and/or filters for directing a slurry continuously onto the work during a surfacing operation. With the novel pad disclosed herein it is necessary only to wet the surface of the pad at the commencement of a surfacing operation, and possibly to squirt a supplemental amount of liquid onto the pad during prolonged surfacing operations. In any event, it is not necessary continuously to direct a stream of liquid onto the pad because of the gel-like coating formed thereon at the outset of the operation. To prevent the dry carrier or matrix forming material from diluting the cutting effect of the abrasive it is preferred that the ratio of abrasive to dry carrier be kept as high as possible.

Referring now to the embodiment shown in FIGS. 4 and 5, 10' denotes a pad which is similar to that disclosed in the first embodiment (FIGS. 1 to 3) with the exception that the substrate layer 14 has formed therethrough a plurality of openings. In the embodiment shown in FIG. 4 these include a center opening 22, which is located in the center of substrate 14, and one opening 23 in each of the radially projecting sections 21 of substrate 14. Each of these openings in the substrate layer 14, such as shown for example by the opening 22 in FIG. 5, is filled with part of the surfacing layer 15—i.e., a mixture of the matrix 16 and the abrasive particles 17. In practice it has been found that substrates 14 containing holes such as those shown at 22 and 23 help the polishing or fining cycle by acting as reservoirs for the surfacing material, and result in an improved reduction in the lens temperature during a polishing or fining operation, and also increase stock removal. Particularly in the case of polishing, pads of this type reduce waves and surface abrasions, and increase the lubricity which helps to extend the life of the pad.

While in the embodiment illustrated in FIGS. 4 and 5 the holes 22 and 23 are placed in the center and centrally of each petal of the substrate 14, it is to be understood that these holes can vary in size, and an also be positioned randomly in the substrate without departing form this invention.

Also, while the invention has been described above as being particularly suitable for use in connection with pads that are coated with the surfacing layer 15, it has been found that satisfactory polishing or fining of lens surfaces can be effected by applying a paste-like mixture of the matrix 16 and particles 17 directly to the surface of the lens or other item which is to be polished or fined. In such case the surfacing pad itself consists simply of the adhesive layer 12 and the substrate layer 14. This pad would then be attached by the adhesive layer 12 to the associated lap, and the uncoated surface of layer 14—(i.e., layer 14 without the surfacing layer 15) would be applied against the paste-like coating (16 and 17) that was previously applied to the surface of the lens or other article that is to be fined or polished. The associated machine would then be run for a period of time in the manner as disclosed above in connection with pads of the type bearing the surfacing layer 15. One such example using a paste of the type noted above is as follows:

EXAMPLE NO. 4

Polishing Pad

The gel/abrasive matrix was prepared in the same manner as explained above in connection with Example No. 1. The resulting paste, however, rather than being coated as a layer 15 onto a pad substrate 14, as suggested in Example No. 1, instead was applied in paste form directly to the face of the lens which was to be polished as noted hereinafter.

Testing

The polishing pad employed in this Example No. 4 was similar to that shown in FIGS. 4 and 5 of this application, except that it did not include the polishing layer 15, but instead comprised the perforated substrate layer 14 containing the openings 22 and 23, and the backing or adhesive layer 12. This pad was attached by its adhesive layer 12 to the lap of a Coburn 505 polishing machine which was set on low speed, and at a pressure of 20 psi. A plastic lens such as the type sold by PPG as a CR-39 lens, was then mounted on the machine, and its face was coated with a layer of the gel/abrasive paste which , as noted above, was produced in accordance with the teachings of Example No. 1 above.

The coated lens was then polished for three minutes at a polishing speed of about 200 rpm. Periodically (approximately every thirty seconds) the temperature of the lens was measured by using an infra-red sensor. The results indicated that the temperature of the lens during polishing increased to no more than approximately 118° F., and during that three minute interval the pad and lens remained very moist without the addition of any additional liquid whatsoever to the interface between the pad and the lens. A second lens was tested in the same manner, and the results were substantially the same as in connection with the test conducted on the first lens; and in each case the stock removal rate was a very satisfactory seventy-two mg. per three minute polishing cycle.

Obviously pads of the type disclosed herein can be utilized to surface rigid products or work pieces other than optical lenses, for example in the lapidary and gem making art. Also, while other organic compounds could be used as gel producing matrices, such as for example polyvinyl alcohol, polyethelene glycol, alginates, gums, and combinations thereof, they are not quite as effective as the above-noted water absorbing or retaining materials such as cellulose based materials and the like. Also in addition to fabric substrates such as denoted at 14, other flexible, water absorbing and retaining substrates could be employed without departing from this invention.

Moreover, although this invention has been illustrated and described in detail in connection with only certain embodiments thereof, it will be apparent that it is capable of still further modification, and that this application is intended to cover any such further modifications as well as those that fall within the scope of the appended claims.

We claim:

1. An abrasive surfacing article, comprising a flexible substrate, a flexible, dehydrated gel producing matrix layer coated on a surface of said substrate, and operative to form a gel upon being wetted with an aqueous solution, and a plurality of abrasive particles dispersed throughout said matrix layer, said matrix layer comprising a material selected form the group consisting essentially of cellulose based materials, clays, silicas, gums, polyvinyl alcohol, polyethylene glycol, alginates, and combinations thereof, said substrate comprising a water-absorbent material operative to function as a reservoir of the aqueous solution which is used to wet said matrix layer, and said matrix upon being wetted with said aqueous solution being operative to hold said abrasive particles in the presence of said solution.

2. An abrasive surfacing article as defined in claim 1, wherein said abrasive particles have a Knoop hardness of at least 1000, and an average particle size in the range of about 0.1 to 50.0 micrometers.

3. An abrasive surfacing article as defined in claim 1, wherein said substrate is made of an absorbent fabric.

4. An abrasive surfacing article as defined in claim 1, wherein the weight ratio of said abrasive particles to said material comprising said matrix layer falls in the range of approximately 2.5:1 to 15.1.

5. A method of preparing an optical quality surface on a workpiece, comprising providing a surfacing pad having a liquid absorbent, flexible substrate coated with a liquid absorbent, flexible matrix, said matrix being selected from the group consisting of cellulose based materials, clays, silicas, gums, polyvinyl alcohol, polyethylene glycol, alginates and combinations thereof, having a plurality of abrasive particles dispersed therein, applying to said pad a small quantity of aqueous solution sufficient to wet said matrix to cause it to gel, and to saturate said substrate, and rubbing the surfaces of said workpiece and said wetted matrix, respectively, one relative to the other, thereby to create an abrasive surfacing gel between said workpiece and said pad substrate.

6. The method is defined in claim 5, including applying said aqueous solution to said pad prior to commencement of rubbing said one surface relative to the other, and completing the surfacing of said workpiece without applying any additional aqueous solution to said pad.

7. An abrasive surfacing article as defined in claim 1, wherein said substrate has therethrough a plurality of spaced openings, and said matrix layer extends into and fills said openings.

8. An abrasive surfacing article as defined in claim 1, wherein said substrate is generally petal-shaped in configuration, and includes a central section having angularly spaced petal-shaped sections projecting radially therefrom, and each of said petal-shaped sections of said substrate having therethrough at least one opening filled by a portion of said matrix layer.

9. A method of preparing an optical quality surface on a workpiece, comprising preparing a viscous, paste-like, abrasive gel by mixing water, abrasive particles, and a material selected from the group consisting of cellulose based materials, clays, silicas, gums, polyvinyl alcohol, polyethylene glycol, alginates and combinations thereof, applying the paste-like gel selectively to the face of the workpiece that is to be prepared, or to the face of a surfacing pad, and rubbing the face of said surfacing pad against the face of said workpiece to remove material from the face of said workpiece without applying any additional liquid to the interface between said pad and said workpiece.

10. An abrasive composition for use in preparing an optical quality surface on the face of a workpiece, comprising a mixture of water, abrasive particles, and a material selected from the group consisting of cellulose based materials, clays, silicas, gums, polyvinyl alcohol, polyethylene glycol, alginates and combinations thereof.

11. An abrasive composition as defined in claim 10, wherein said particles have a knoop hardness of at least 1000 and an average particle size in the range of about 0.1 to 50.0 microns.

* * * * *